US007331805B1

(12) United States Patent
Hu

(10) Patent No.: US 7,331,805 B1
(45) Date of Patent: Feb. 19, 2008

(54) DETECT SWITCH PROVIDED WITH AN ELECTRICAL MEMBER

(75) Inventor: Yong-Hui Hu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 15 days.

(21) Appl. No.: 11/704,439

(22) Filed: Feb. 9, 2007

(51) Int. Cl.
*H01R 13/53* (2006.01)
*H01H 9/00* (2006.01)

(52) U.S. Cl. ..... 439/188; 200/314

(58) Field of Classification Search ..... 200/313, 200/314, 50.01, 5, 51.1, 406; 439/188
See application file for complete search history.

(56) References Cited

U.S. PATENT DOCUMENTS 4,096,368 A * 6/1978 Grebner ..... 200/314
7,202,429 B2 * 4/2007 Bouvier et al. ..... 200/310

FOREIGN PATENT DOCUMENTS

WO WO2005/027163 3/2005

* cited by examiner

*Primary Examiner*—Briggitte R. Hammond
(74) *Attorney, Agent, or Firm*—Wei Te Chung

(57) ABSTRACT

A detect switch (100) includes an insulative housing (2), a first, a second and a third fixed terminals (11, 12, 13), a moveable contact (3) contactable to the third fixed terminal, an operator (4) capable of depressing the moveable contact, an operator (8) and an actuator (9). An LED (6) has a pair of cantilevered arms (62) contacting with the second fixed terminal and is fixed in the insulative housing for immovably fastening the LED to the insulative housing. When the operator is downwardly pushed by the actuator to thereby depress the moveable contact, the moveable contact has a central contact portion thereof being downwardly depressed for contacting with the first fixed terminal to thereby establish an electrical connection between the first and the third fixed terminals.

16 Claims, 6 Drawing Sheets

DETECT SWITCH PROVIDED WITH AN ELECTRICAL MEMBER

BACKGROUND OF THE INVENTION

1. Field of the Invention

The present invention relates to a detect switch, and particularly to a detect switch provided with an electrical member such as a Light Emitting Diode (LED), used in various electronic devices.

2. Description of Related Art

A conventional detect switch provided with a light source is described in WO patent publication No. 2005/027163 published on Mar. 24, 2005. The detect switch provided with a light source comprises an insulative housing, and a plurality of connecting pieces, a central pad, a dome, an operation member moveably retained in the insulative housing, an actuator, a cover attached to a top of the insulative housing, and a sealing sheet interposed between the cover and the insulative housing. The connecting pieces are axially offset relative to each other and define thereon a plurality of contact regions, which include a plurality of first and second fixed terminals formed thereon. The first fixed terminals are connected to both the light source and the outwardly extending second fixed terminals. The dome has a central contact portion disposed above the central pad. The dome is capable of being deformed by displacement of the operation member between a first and a second state of commutation. The operation member is provided with at least two contact elements which connect the light source to the first fixed terminals. In operation, when the actuator is pushed downwardly due to an external force exerted thereon, the operation element together with the light source is urged to move downwardly for depressing the dome. The central contact portion of the dome is downwardly depressed for contacting with the central pad to thereby establish an electrical connection between the contact regions via the central pad.

As described above, the light source would move downwardly together with the operation element and the actuator in operation. It would result in unreliable connection between the light source and the first fixed terminal.

Hence, an improved electrical connector is required to overcome the above-mentioned disadvantages of the related art.

SUMMARY OF THE INVENTION

A primary object of the present invention is to provide a detect switch having reliable connection to the corresponding fixed terminals.

To achieve the aforementioned object, a detect switch comprises an insulative housing, a first, a second and a third fixed terminals respectively provided with a first contact portion, a pair of second contact portions and a pair of third contact portions exposed to outside, a moveable contact to be in contact with the third contact portions, an operator capable of depressing the moveable contact, and an actuator adapted for driving the operator to downwardly depress the moveable contact. An LED having a pair of upholding cantilevered arms is in contact with the second contact portions. The cantilevered arms of the LED are fixed in the insulative housing for fastening the LED to the insulative housing. When the operator is downwardly pushed by the actuator, said moveable contact contacting with the third fixed terminal has a central contact portion downwardly depressed by the operator for contacting with the first contact portion of the first fixed terminal to thereby establish an electrical connection between the first and the third fixed terminals.

The cantilevered arms uphold the LED and immovably fasten the LED to the insulative housing in operation. It is beneficial for the LED to reliably contact with the second contact portions of the second fixed terminals.

Other objects, advantages and novel features of the invention will become more apparent from the following detailed description of a preferred embodiment when taken in conjunction with the accompanying drawings.

DETAILED DESCRIPTION OF THE INVENTION

Figure 1:
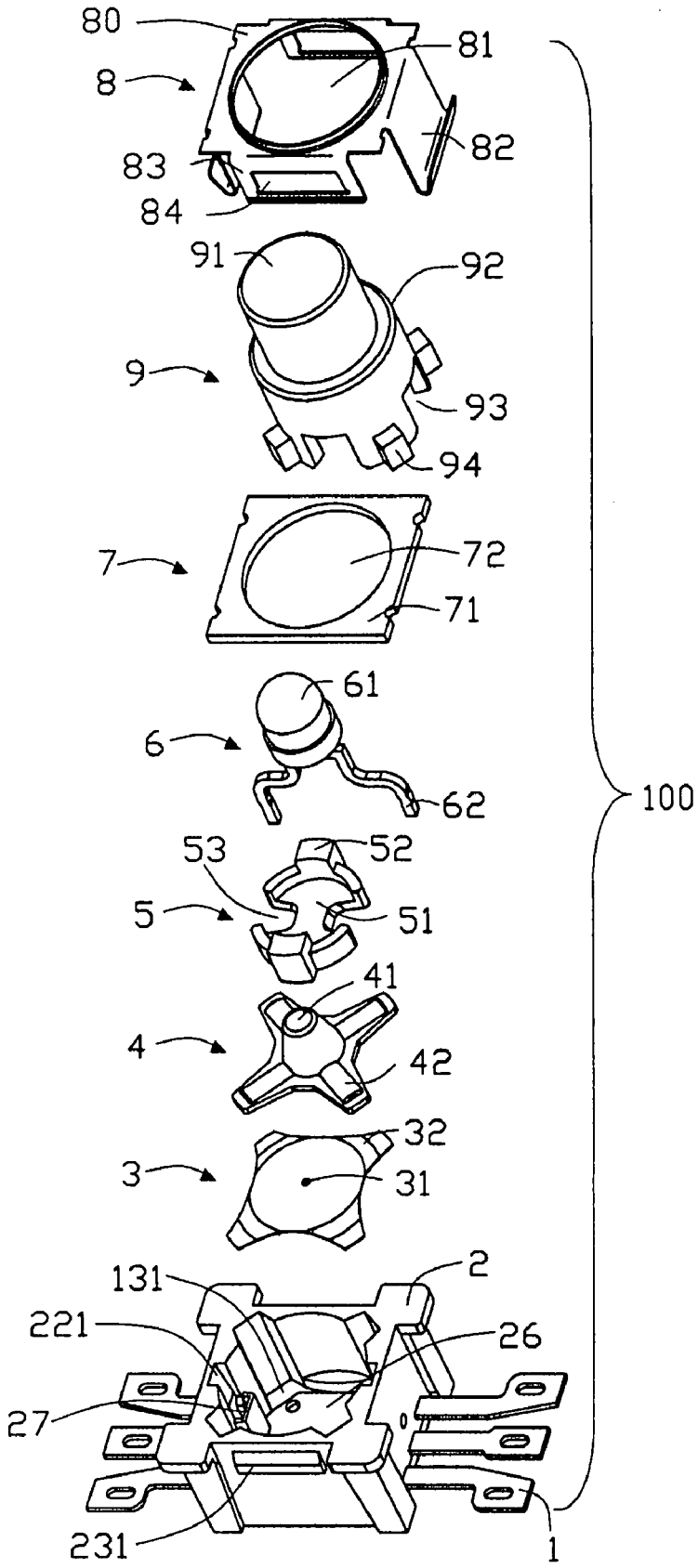
FIG. 1 is an exploded perspective view of a detect switch in accordance with the present invention.

Reference will now be made to the drawing figures to describe the present invention in detail. Referring to FIG. 1, a detect switch 100 in accordance with the preferred embodiment of the present invention is adapted for electrically connecting with an LED 6. In fact, the switch 100 may also be used for other kinds of electrical member in other embodiments. The detect switch 100 comprises an insulative housing 2 defining a cavity 26, a plurality of fixed terminals 1 embedded in the insulative housing 2, a moveable contact 3 retained in the cavity 26 of the insulative housing 2, an operator 4 exposed above the moveable contact 3, a retention portion 5 positioned on the operator 4, an LED 6 located above the retention portion 5, an actuator 9 assembled to the insulative housing 2, a cover 8 attached to a top of the insulative housing 2, and a gasket 7 interposed between the insulative housing 2 and the cover 8.

Figure 3:
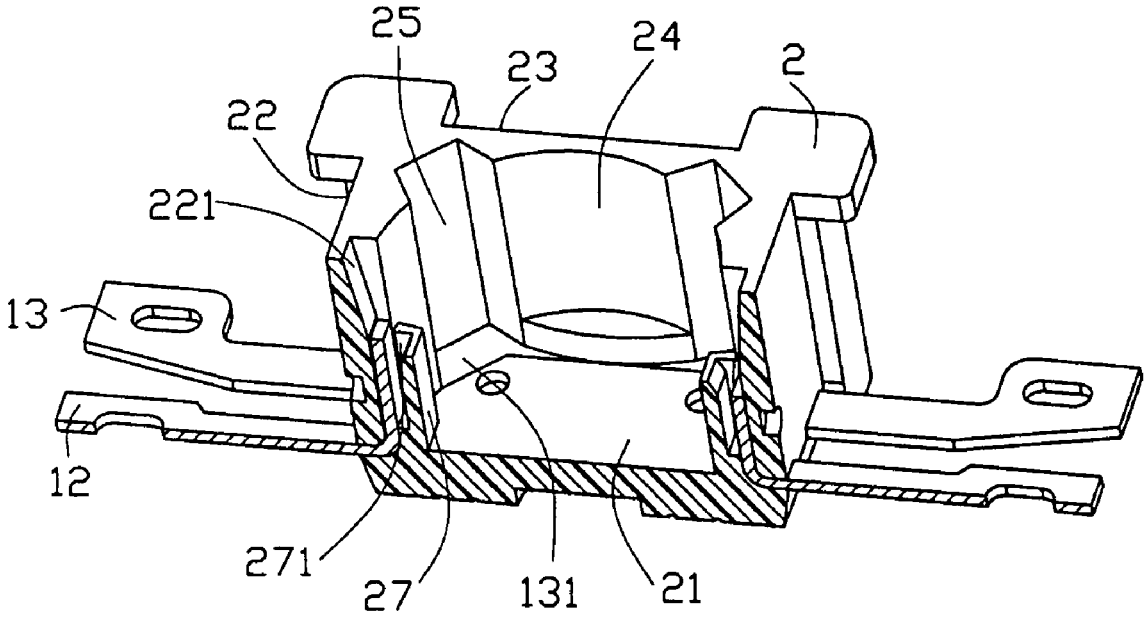
FIG. 3 is a partially perspective view of an insulative housing, to which the fixed terminals are assembled.

Referring to FIG. 3 in conjunction with FIG. 1, the insulative housing 2 is a substantially rectangular case, comprising a bottom wall 21, a pair of opposite periphery walls 22 and a pair of opposite side walls 23 raising upwardly from the bottom wall 21 to thereby define the cavity 26 therebetween. Each periphery wall 22 has an engaging slot 221 defined thereon in a top-to-bottom direction. The pair of side walls 23 respectively have a first recess 24 having a semi-curved surface defined in an inner surface thereof and a tuber 231 formed at an outer surface thereof. The cavity 26 has four rectangular second recesses 25 defined at four corners thereof, and a pair of fixing portions 27 respectively surrounding corresponding engaging slots 221. Each fixing portion 27 defines therein an insertion slot 271 communicating with the engaging slot 221.

Figure 2:
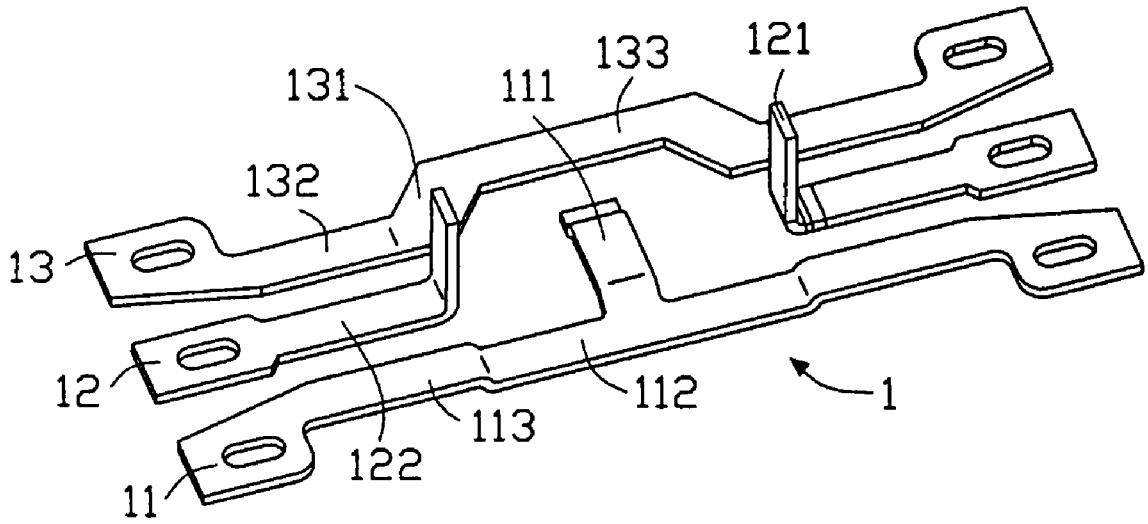
FIG. 2 is a perspective view of a plurality of fixed terminals as shown in FIG. 1.

Referring to FIG. 2, the plurality of fixed terminals 1 each comprises a T-shaped first fixed terminal 11, a second fixed terminal 12, and a third fixed terminal 13. The first fixed terminal 11 is formed with a body portion 112 extending in a longitudinal direction, a pair of first soldering portions 113 extending laterally along an extending direction of the body portion 112. The body portion 112 has a first contact portion 111 protruding perpendicularly from a center portion thereof. The second fixed terminal 12 has a pair of second soldering portions 122 extending parallel to the first soldering portions 113, and a pair of second contact portions 121 raising perpendicularly to inner ends of the second soldering portions 122. The third fixed terminal 13 has a pair of third soldering portions 132 extending parallel to the second soldering portions 122, a pair of third contact portions 131 bending obliquely from inner ends of the third soldering portions and a connection portion 133 connecting the pair of third contact portions 131 together. The connection portion 133 and the pair of third contact portions 131 are connected as a whole to generally shaped as an inverted "U".

Referring to FIG. 1, the dome-like moveable contact 3 comprises a central contact portion 31 and four periphery contact portions 32 symmetrically formed around the central contact portion 31.

The operator 4 comprises a button 41 having a beveled surface and four projection beams 42 projecting radially from a lower portion of the button 41.

The retention portion 5 is formed with a body portion 51 having a curved outer surface for corresponding to the first recesses 24, a pair of indentations 53 symmetrically defined thereon, and a pair of engaging portions 52 symmetrically formed at an outer surface of the body portion 51.

The LED 6 comprises a light source 61 and a pair of substantially Z-shaped cantilevered arms 62 extending downwardly from the light source 61 for insertion into the insertion slots 271 of the insulative housing 2 and for fixing the LED 6 in the cavity 26.

The actuator 9 comprises a cylindrical base portion 92, and an upper portion 91 having a diameter smaller than that of the base portion 92. The base portion 92 has four protrusions 94 symmetrically formed around an outer surface thereof, and four cutouts 93 each defined between a pair of adjacent protrusions 94.

The cover 8 comprises a top face 80 defining an extension hole 81, a pair of periphery faces 82 extending downwardly from a pair of opposite sides of the top face 80, and a pair of bent portions 83 bent perpendicularly to another pair of opposite sides of the top face 80. Each bent portion 83 has an engaging groove 84 defined thereon for engaging with the tubers 231 of the insulative housing 2.

The gasket 7 is substantially a rectangular board, comprising a board portion 71 and a circular mounting hole 72 defined therein.

Figure 4:
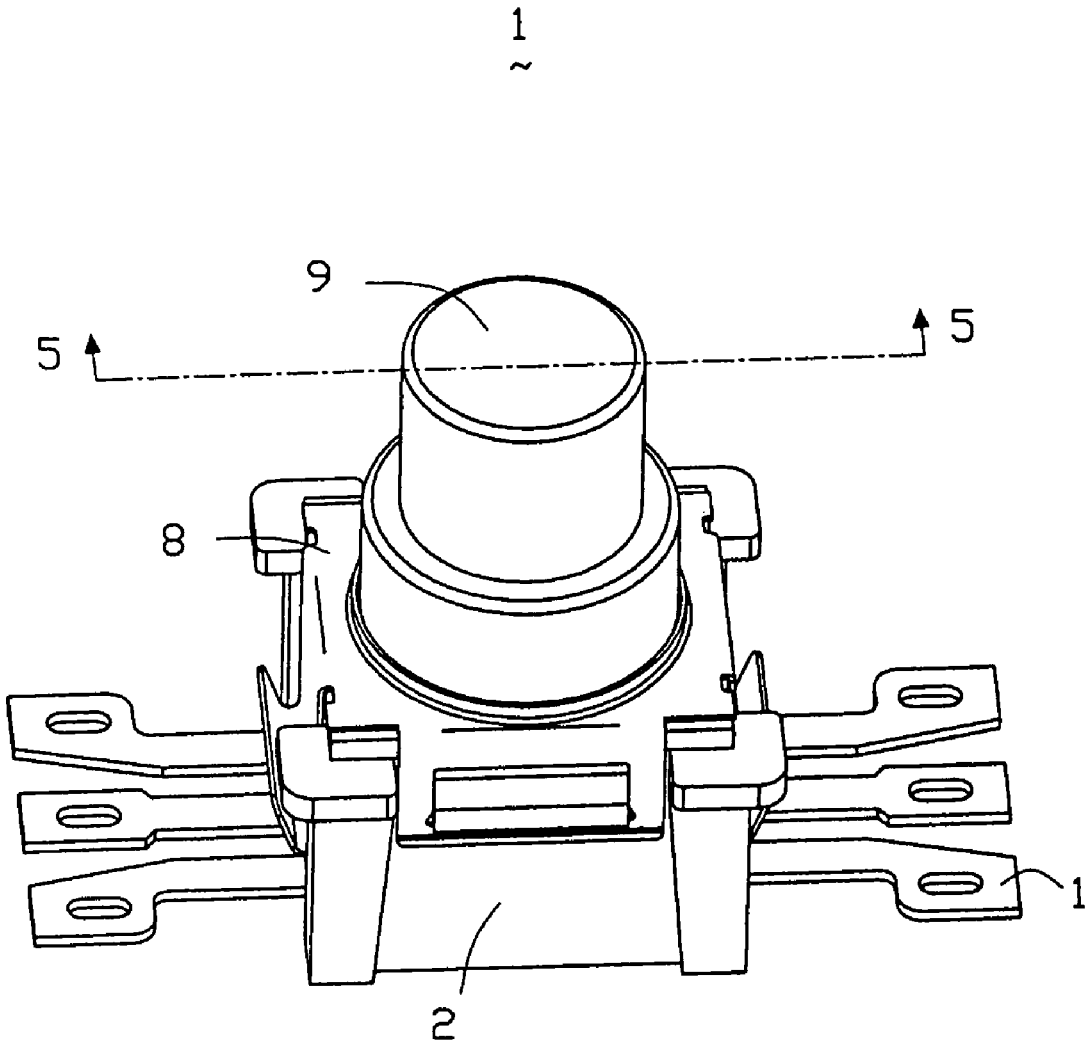
FIG. 4 is an assembled perspective view of the detect switch as shown in FIG. 1.
Figure 5:
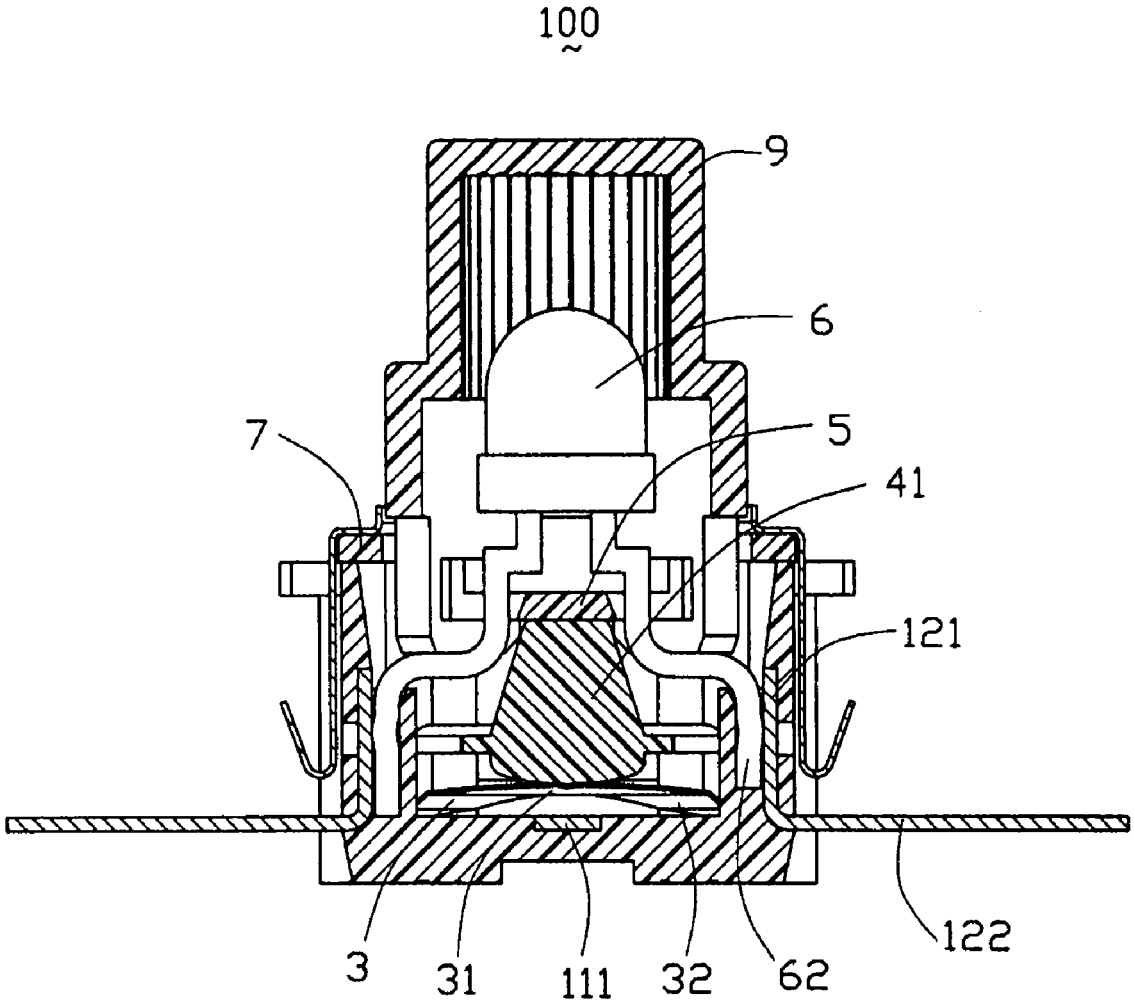
FIG. 5 is a cross-sectional view taken along line 5-5 in FIG. 4.

Referring to FIGS. 1, 4, 5, in assembly of the detect switch 100, the plurality of fixed terminals 1 are assembled to the insulative housing 2 by insert molding, with the first, second and third soldering portions 113, 122, 132 thereof extending outside of the insulative housing 2. The first fixed terminal 1 is disposed in the insulative housing 2, with the body portion 112 thereof embedded in the bottom wall 21 while the first contact portion 111 thereof exposed in the cavity 26. The second fixed terminals 12 are mounted on the insulative housing 2, with the second contact portions 121 thereof exposed in the engaging slots 221 for contacting with the cantilevered arms 62 of the LED 6. As for the third fixed terminals 13, the connection portion 133 thereof is embedded in the bottom wall 21, and the third contact portions 131 are accommodated in the second recesses 25 and exposed in the cavity 26.

The moveable contact 3 is disposed on the bottom wall 21 of the insulative housing 2, with a pair of periphery contact portions 32 thereof engaging with corresponding second recesses 25 and contacting with the third contact portions 131 of the third fixed terminals 3, and with the central contact portion 31 positioned a certain distance above the first contact portion 111. The operator 4 is received in the cavity 26, with the button 41 thereof positioned above the central contact portion 31, and the projection beams 42 thereof retained in the second recesses 25 and corresponding to the periphery contact portions 32. The retention portion 5 is mounted on the operator 4, with a lower surface of the body portion 51 being resisted against by the button 41, and with the engaging portions 52 engaging with the first recesses 24. The LED 6 is fastened to the insulative housing 2, with the light source 61 thereof exposed above the retention portion 5, and the cantilevered arms 62 thereof extending through the indentations 53 and then being inserted into the insertion recesses 271 for contacting with the second contact portions 121.

The actuator 9 is fixed on the retention portion 5, with the cutouts 93 thereof engaging with the engaging portions 52. The base portion 92 engages with the first recesses 24, and the protrusions 94 are inserted into the corresponding second recesses 25. The light source 61 is received in the actuator 9. The gasket 7 is interposed between the cover 8 and the insulative housing 2 to eusure a proper sealing therebetween. The periphery faces 82 of the cover 8 are attached to outer surfaces of the periphery walls 22, and the engaging grooves 84 thereof engage with the tubers 231. The actuator 9 extends outwardly through the mounting hole 72 and the extension hole 81 in sequence. The detect switch 100 is assembled as a whole finally.

Figure 6:
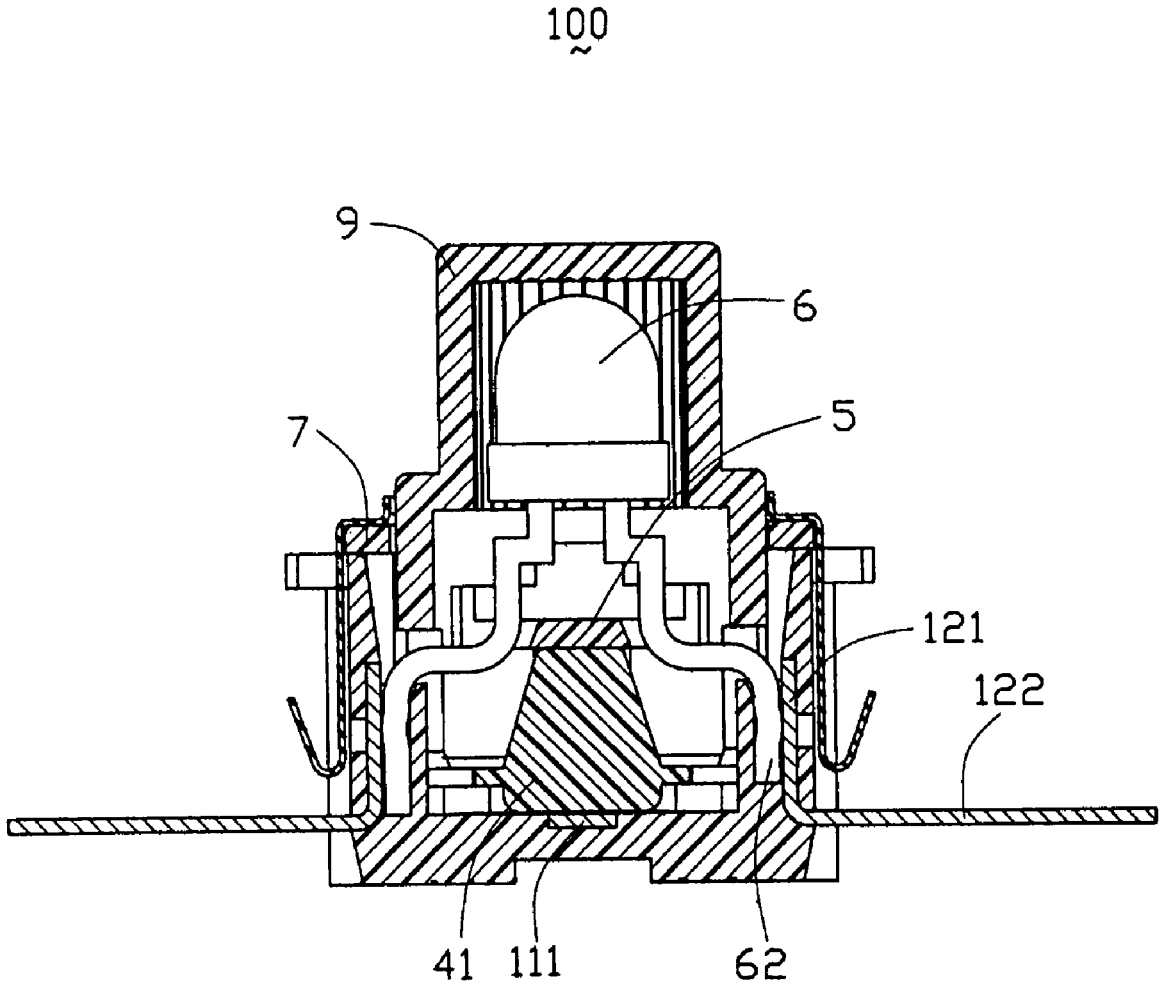
FIG. 6 is a view similar to FIG. 5 but showing the detect switch in operation.

Referring to FIG. 6, in conjunction with FIG. 5, in operation, the actuator 9 is downwardly pushed by exerting an external force thereon. The retention portion 5 and therefore the button 41 are urged downwardly for depressing the central contact portion 31 of the moveable contact 3. The LED 6 does not move even though the retention portion 5 positioned therebelow moves downwardly. The moveable contact 3 contacting with the third contact portion 131 of the third fixed terminal 3 in a normal position is then forced to deform and have the central contact portion 31 downwardly depressed for contacting with the first contact portion 111 of the first fixed terminal 11 to thereby establish an electrical connection between the first and the third fixed terminals 11, 13.

When the external force is removed, the detect switch 100 restores itself to a normal position due to a resilient force from a deformation of the moveable contact 3 and the button 41.

However, the disclosure is illustrative only, changes may be made in detail, especially in matter of shape, size, and arrangement of parts within the principles of the invention.

What is claimed is:

1. A detect switch, comprising:

an insulative housing defining a cavity therein;

a plurality of fixed terminals embedded in the insulative housing, the fixed terminals comrising a first, a second and a third fixed terminals respectively provided with a first contact portion, a pair of second contact portions and a pair of third contact portions exposed in the cavity;

a moveable contact retained in the cavity and being contactable to said third contact portions of said third fixed terminal;

an electrical member having a pair of cantilevered arms upholding the electrical member and contacting with the second contact portions, said cantilevered arms being fixed in the insulative housing for immovably fastening the electrical member to the insulative housing;

an actuator moveably assembled to the insulative housing; and an operator positioned between the actuator and the moveable contact;

wherein when the operator is downwardly pushed by the actuator to thereby depress the moveable contact, said moveable contact contacting with the third fixed terminal has a central contact portion thereof being downwardly depressed by the operator for contacting with the first contact portion of the first fixed terminal to thereby establish an electrical connection between the first and the third fixed terminals.

2. The detect switch as claimed in claim 1, wherein said electrical member comprises a light source and each cantilevered arm in substantially Z-shaped extends downwardly from the light source.

3. The detect switch as claimed in claim 1, wherein said insulative housing has a pair of fixing portions formed in the cavity for confining the cantilevered arms of the electrical member.

4. The detect switch as claimed in claim 3, wherein each fixing portion has an insertion slot defined therein for insertion of said cantilevered arm of the electrical member.

5. The detect switch as claimed in claim 4, wherein said first, second and third fixed terminals respectively have a pair of first, second and third soldering portions extending outside of the insulative housing, said second contact portions rising perpendicularly to the second soldering portions.

6. The detect switch as claimed in claim 5, wherein said insulative housing comprises a bottom wall, a pair of opposite periphery walls and a pair of side walls rising from the bottom wall, each of said periphery walls respectively defining an engaging slot communicating with said insertion slot for engaging with the second contact portion.

7. The detect switch as claimed in claim 6, wherein said insulative housing has a pair of first recesses defined on the side walls, and four second recesses defined at four corners thereof for engaging with the pair of third contact portions.

8. The detect switch as claimed in claim 7, wherein said actuator comprises a base portion received in the cavity, and a plurality of protrusions formed around the base portion for engaging with the second recesses.

9. The detect switch as claimed in claim 8, further comprising a retention portion mounted between the actuator and the operator and provided with a pair of engaging portions, wherein said base portion has a pair of cutouts each defined between two adjacent protrusions for engaging with a corresponding engaging portion.

10. The detect switch as claimed in claim 9, wherein said retention portion is formed with a body portion, a pair of indentations symmetrically defined on the body portion for extension of the cantilevered arms of the electrical member.

11. The detect switch as claimed in claim 7, wherein said moveable contact is formed as a dome-like shape and has two pairs of periphery contact portions formed around the central contact portion for engaging with the second recesses, and wherein one pair of periphery contact portions contact with the third contact portions.

12. The detect switch as claimed in claim 11, wherein said operator is formed with a button adapted for depressing the central contact portion and a plurality of projection beams corresponding to the periphery contact portions of the moveable contact.

13. The detect switch as claimed in claim 6, further comprising a cover attached to a top of the insulative housing, wherein said cover has a top wall defining an extension hole for extension of said actuator, a pair of periphery faces attaching to an outer face of the periphery walls, and a pair of bent portions defining a pair of engaging grooves for engaging with a pair of tubers formed on the side walls of the insulative housing.

14. The detect switch as claimed in claim 13, further comprising a gasket interposed between the cover and the top of the insulative housing.

15. A contact switch comprising:

an insulative base;

a plurality of fixed terminal including first terminal, a pair of second terminals and a third terminal being disposed in the base under a fixed manner, wherein the pair of second terminals being opposite to each other in a first direction while the first terminal and said third terminal being opposite to each other in a second direction perpendicular to said first direction;

a moveable contact located above said fixed terminals with an up-and-down deflectable center portion;

an LED located above the moveable contact and having two leads respectively connected to the corresponding second terminals under an immovable manner; and an actuator covering said LED and equipped with an abutment section on a lower portion thereof; wherein said actuator is up and down moveable so as to indirectly downwardly deflect the moveable contact to electrically connect said first terminal and said third terminal.

16. The contact switch as claimed in claim 15, further including an operator vertically located between the LED and the moveable contact to directly engage the moveable contact.

* * * * *